United States Patent [19]

Skiera

[11] Patent Number: 4,815,377

[45] Date of Patent: Mar. 28, 1989

[54] ENGAGING AND DISENGAGING DEVICE FOR BLANKET CYLINDERS OF A FOUR-CYLINDER PRINTING ASSEMBLY FOR ROLLER ROTARY OFFSET PRINTING MACHINES

[75] Inventor: Heinz Skiera, Leipzig, German Democratic Rep.

[73] Assignee: Veb Kombinat Polygraph "Werner Lamberz" Leipzig, Leipzig, German Democratic Rep.

[21] Appl. No.: 179,386

[22] Filed: Apr. 8, 1988

[30] Foreign Application Priority Data

Jun. 22, 1987 [DD] German Democratic Rep. ..... 3040090

[51] Int. Cl.[4] ..... B41F 7/02; B41F 3/00

[52] U.S. Cl. ..... 101/218; 101/220; 101/352

[58] Field of Search ..... 101/352, 218, 220, 349, 101/351, 145, 137, 139, 140, 209

[56] References Cited

U.S. PATENT DOCUMENTS

| | | | |
|---|---|---|---|
| 2,874,636 | 2/1959 | Royer et al. | 101/218 |
| 3,030,884 | 4/1962 | Lindemann | 101/218 |
| 3,067,674 | 12/1962 | Tyma, Jr. et al. | 101/218 |
| 3,196,786 | 7/1965 | Hornberger et al. | 101/218 X |
| 3,527,165 | 9/1970 | Harless | 101/220 |
| 3,633,503 | 1/1972 | Tafel | 101/220 |
| 3,691,956 | 9/1972 | James et al. | 101/352 |
| 4,218,972 | 8/1980 | Fujishiro | 101/218 |
| 4,281,595 | 8/1981 | Fujishiro | 101/218 |
| 4,442,773 | 4/1984 | Kobayashi | 101/218 |
| 4,458,590 | 7/1984 | Egnaczak | 101/218 |
| 4,458,591 | 7/1984 | Guaraldi | 101/218 |
| 4,524,712 | 6/1985 | Ito | 101/352 |
| 4,643,090 | 2/1987 | McKrell et al. | 101/220 |
| 4,783,297 | 1/1980 | Skiera | 101/218 |

*Primary Examiner*—Eugene H. Eickholt
*Attorney, Agent, or Firm*—Michael J. Striker

[57] ABSTRACT

A device for engaging and disengaging of blanket cylinders in a printing assembly including two such blanket cylinders and two plate cylinders which are external relative to the blanket cylinder is disclosed. The device comprises a drive and a gear transmission device cooperating with the drive to impart an angular adjustment movement to each of the blanket cylinders. Each blanket cylinder includes an inner and an outer eccentric sleeve each provided with a toothed segment and movable by the gear transmission device in a predetermined direction to engage or disengage the blanket cylinders.

4 Claims, 3 Drawing Sheets

ENGAGING AND DISENGAGING DEVICE FOR BLANKET CYLINDERS OF A FOUR-CYLINDER PRINTING ASSEMBLY FOR ROLLER ROTARY OFFSET PRINTING MACHINES

BACKGROUND OF THE INVENTION

The present invention relates to a device for engaging and disengaging blanket cylinders of a four-cylinder printing mechanism for a roller rotary offset printing machine in which all four cylinders are positioned obliquely to the direction of running path and one above another; central axes of the cylinders lie approximately on the straight line.

Printing assemblies of the type under discussion have been known, which have been provided with switch-on and off devices for blanket cylinders of the roller rotary offset printing machine. Such a device has been disclosed, for example in German patent DE-PS 34 12 812. Four cylinders in this known assembly are arranged one above another along the straight line which is inclined relative to the horizontally extending path of running of the machine, and the pins of the blanket cylinders are each positioned in two eccentric sleeves arranged one inside the other in a bore of the wall of the printing mechanism. These two sleeves are arranged in that bore with the same eccentricity. The inner and outer eccentric sleeves are connected to each other by a common pulling rod and are adjustable, via another pulling rod, by means of an adjusting device in such a fashion that the blanket cylinders move in opposite directions by angle 90° relative to the inclined straight line linearly, whereby the central axes of the pins of the blanket cylinders are positioned at the different sides of the straight line and spaced from said straight line at the smallest intervals.

This known device has the disadvantage which resides in that due to the linear movement to the right relative to the straight line connecting the central axes of the plate cylinders, the infeed between the blanket or internal cylinders almost doubles as compared to the infeed between the respective blanket cylinder and respective plate cylinders which results in respectively different adjustment forces. Due to wear, the adjustment forces between the pairs of the cylinders of the printing assembly should be changed, and therefore in each pair the cylinders must be connected to each other and disconnected from each other individually. Many required adjustment structural components provided for this purpose thus lead to considerable expenses.

The printing assembly of the type under discussion has been disclosed also, for example in applicant's U.S. Pat. No. 4,183,297 the disclosure of which is incorporated herein by reference.

SUMMARY OF THE INVENTION

It is an object of the present invention to provide an improved device for engaging and disengaging blanket and plate cylinders in a four cylinder printing assembly of a roller rotary offset printing machine.

It is another object of this invention to provide an engaging and disengaging device for blanket cylinders which is simple and inexpensive to manufacture and which is reliable in use.

Yet another object of this invention is to provide blanket cylinders of the printing assembly with individual engagement and disengagement devices which would generate exactly the same adjusting forces between two blanket cylinders, which are internal cylinders in the printing assembly, and between respective blanket cylinders and plate cylinders which are the external cylinders in the assembly.

These and other objects of the invention are attained by an engagement-and-disengagement device for blanket cylinders in combination with a four cylinder printing assembly of a roller rotary printing machine in which axes of rotation of four cylinders positioned one above another lie on a straight line inclined to a direction of a running path and pins of said blanket cylinders are arranged each in two eccentric sleeves supported in bores of a wall of the printing assembly, a ratio between an eccentricity ($e_1$) of an inner sleeve of each blanket cylinder and an eccentricity ($e_2$) of an outer sleeve of each blanket cylinder being greater than 1:1; gear transmission means (13–17) forcibly connecting said eccentric sleeves to each other; and drive means including a thrust piston drive (21), a pulling rod operatively connected to said drive, and a pivotal lever (18) connected to said pulling rod; said gear transmission means including drive toothed segments (14, 17) rigidly connected to said lever, and toothed segments on said inner and outer eccentric sleeves, said drive means via said gear transmission means adjusting the respective inner eccentric sleeve and outer eccentric sleeve by an angular amount in opposite directions relative to each other, and an angular amount of adjustment of a respective inner eccentric sleeve being smaller than the angular amount of adjustment of a respective outer eccentric sleeve, said inner and outer sleeves of each blanket cylinder being adjusted in such a fashion that the blanket cylinders move in opposite directions in reference to the straight line (g) on which the central axes of the pins of the blanket cylinders lie in an engaged position of the blanket cylinders and approximately linearly in a region near a contact area between said blanket cylinders at a calculable angle $\gamma$ to said straight line and in a region remote from said contact area over a curved path, whereby a ratio between a width of a play formed between said blanket cylinders and a width of a play formed between the respective blanket cylinder and a respective plate cylinder of said printing assembly is 1:1 in said region near said contact area and increases in the region remote from said contact area and central axes of said plate cylinders lie on a straight line (g') which extends through the central axis of the pin of the respective blanket cylinder in said engaged position and forms with a direction vector of an approximately linear movement of said central axis of the pin of the blanket cylinder a calculable angle The ratio between the eccentricity of the inner sleeve and the eccentricity of the outer sleeve may be 4:1.

A ratio between the angular amount of adjustment of said inner sleeve and the angular amount of adjustment of said outer sleeve may be 1:2.

Angle $\gamma$ is calculable from three sides of the triangle formed by the half the axial distance between the blanket cylinders in the engaged position, the path of the approximately linear movement of the central axis of the pin of the respective blanket cylinder during the disengagement of the blanket cylinders, and the side, the length of which is the sum of the half the axial distance and the half the desired width of the play between the blanket cylinders at the end of the path of the approximately linear movement.

Angle $\delta$ is calculable from three sides of another triangle, which is formed by the distance between the central axis of the respective plate cylinder and the central axis of the pin of the respective blanket cylinder in the engaged position, the path of the approximately linear movement of the central axis of the pin of the respective blanket cylinder during the disengagement, and the side, the length of which is the sum of the axial distance and the desired play width between the blanket cylinder and the plate cylinder at the end of the path of the approximately linear movement. The path of the approximately linear movement is the path required to disconnect the blanket cylinders from each other or to obtain the middle value of the width of the play between the blanket cylinders.

The inner and outer eccentric sleeves are positioned relative to each other so that their eccentricities lie on the straight line and, with the blanket cylinders engaged with one another, are directed so that this direction includes with the direction vector of the approximately linear movement of the central axis of the pin of the respective blanket cylinder the right angle. This results in that the direction of the eccentricities in the central axis of the blanket cylinder pin deviates by angle $\alpha=\gamma 90°$ from the direction of the straight line which connects the central axes of the pins of the blanket cylinders to each other in the engaged position of these cylinders.

The drive means may further include a threaded sleeve (22) positioned on said pulling rod and provided with a left-hand pitch and a right-hand pitch so that said pulling rod which has a thread thereon is adjustable in length for adjusting forces for engaging and disengaging said cylinders.

During the engagement and disengagement of the blanket cylinders, a translatory movement of the movable piston of the thrust piston drive which serves as a force source, is transmitted, via the pulling rod and the pivotable lever connected thereto, into an angular adjustment of the toothed segments rigidly connected to the pivotable lever. These toothed segments, in turn, transmit this angular adjustment, via the toothings on the inner and outer eccentric sleeves, to these sleeves so that the amount of the annular adjustment of the inner sleeve is smaller than that of the outer sleeve and their adjustments are carried out in opposite directions.

The left-hand angular adjustment of the toothed segment rigidly connected to the pivotable lever, for example for the inner eccentric sleeve of one blanket cylinder, results in half the rotation amount to the left, and for the outer eccentric sleeve, in the right-hand rotation by the whole angle amount. The eccentrics and the gear transmission components are dimensioned so that the blanket cylinder is moved to the right approximately linearly at angle $\gamma$ to the straight line which connects the central axes of the pins of the blanket cylinders in their engaged position. Since, with the equal ratios, the other blanket cylinder is moved in the opposite direction the blanket cylinders are no longer in contact with one another. At the same time, the respective blanket cylinder and plate cylinder are also separated from each other as necessary for a required play. In the region remote from the contact area, the blanket cylinders move away from each other over the curved path so that the width of the play between two blanket cylinders increases stronger than the width of the play between the respective blanket cylinder and respective plate cylinder.

The increasing ratio between the widths of the aforementioned plays has the advantage particularly when an available blanket overlying and the contact-free path, between two blanket cylinders in the disengaged position are taken into consideration.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

DETAILED DESCRIPTION OF THE PREFERRED EMBODIMENTS

Figure 1:
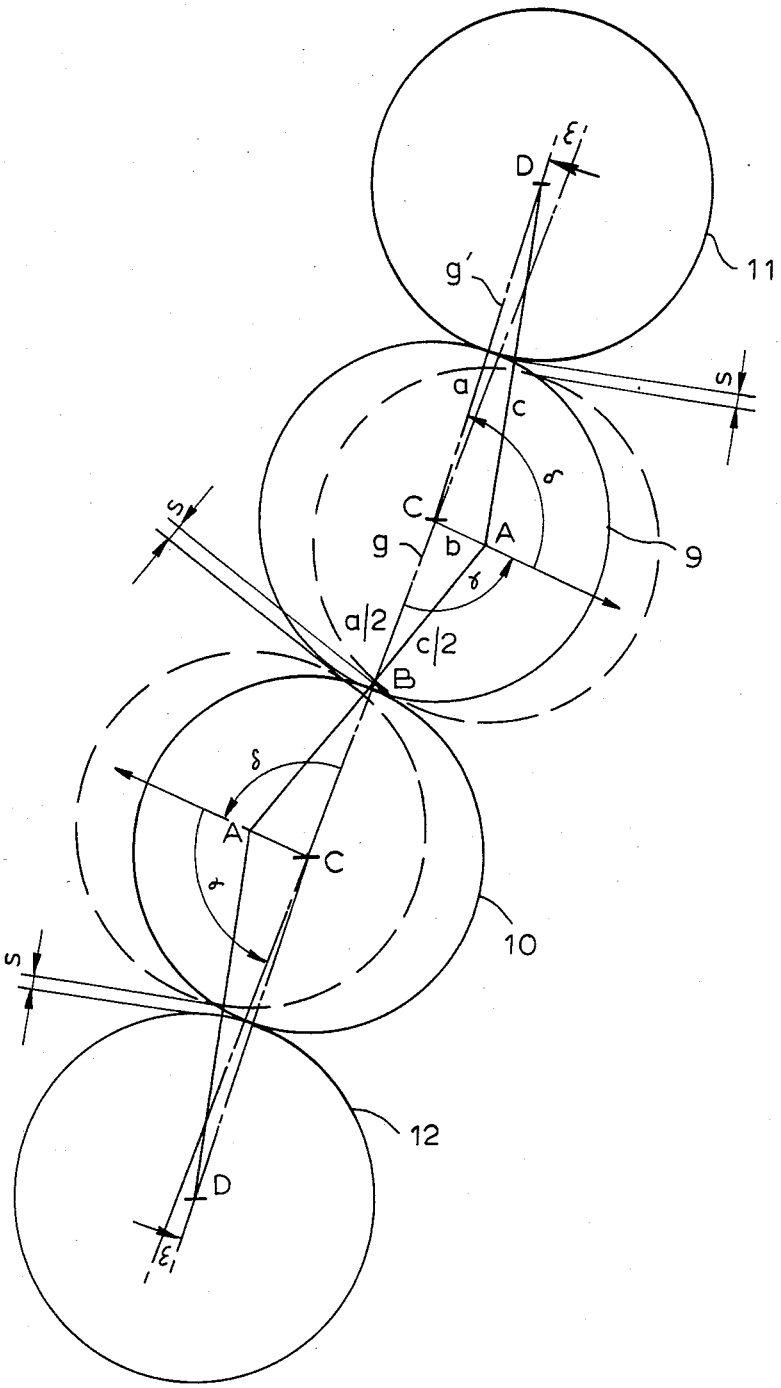
FIG. 1 is a schematic view of a four-cylinder printing assembly with the illustration of the movement amounts in the contact regions between the blanket cylinders and respective plate cylinders when the blanket cylinders are connected or disconnected.
Figure 2:
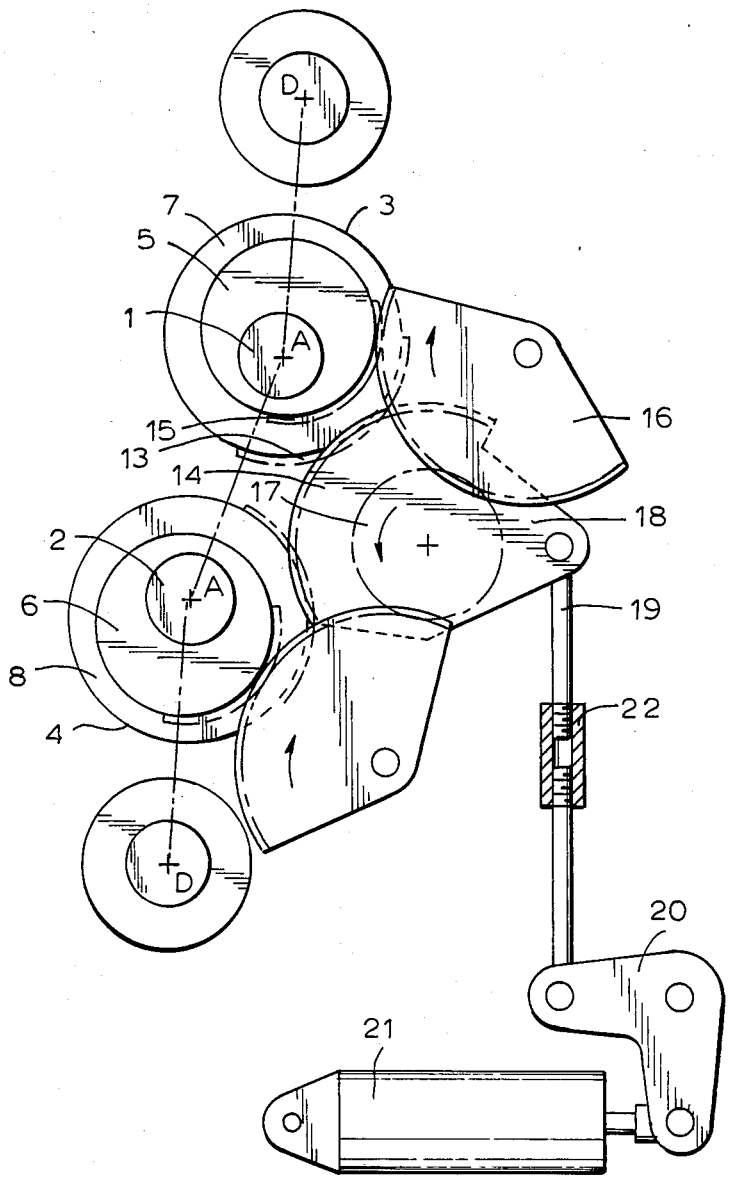
FIG. 2 is a schematic view of the connecting-and-disconnecting device of this invention.
Figure 3:
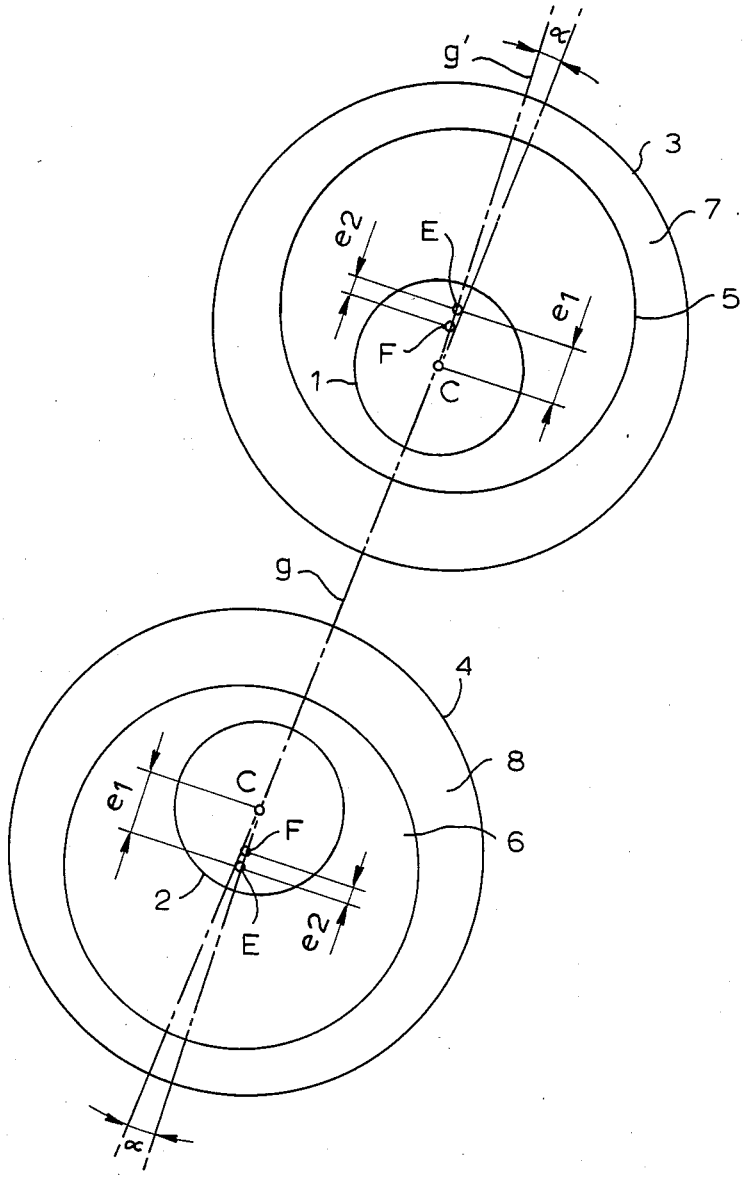
FIG. 3 is a schematic view of the bearing assembly of the blanket cylinder pins in respective two sleeves eccentrically positioned relative to each other.

Referring now to the drawings in detail, reference numerals 9 and 10 designate blanket cylinders while reference numerals 11 and 12 denote plate or outer cylinders of the printing assembly shown in FIG. 1. Each blanket cylinder includes a pin 1, 2. Blanket cylinder pins 1, 2 are positioned in eccentric sleeves 5, 7 and 6, 8, respectively, which sleeves are supported in bores 3, 4 provided in the wall of the printing mechanism, as seen in FIG. 2. The ratio between the eccentricity $e_1$ of the inner eccentric sleeve 5, 6 in each blanket cylinder and the eccentricity $e_2$ of the outer eccentric sleeve 5, 8 is 4:1, as seen from FIG. 3.

Eccentric sleeves 5, 6 have toothed segments 15 while eccentric sleeves 7, 8 have toothed segments 13, respectively. Reference numerals 14, 17 designate drive toothed segments. Toothed segments 13, 15 are integrally fixed with the assigned sleeves (FIG. 2). Eccentric sleeves 5, 6, 7, 8 are connected with the drive toothed segments 14, 14 by means of toothed segment 13, 15, respectively, directly, or by means of a toothed segment 16 indirectly, forcibly. A lever 18 rigidly, e.g. integrally connected with the drive toothed segments 14, 17, a pulling rod 19 and an angle-shaped lever 20 serve to adjust the inner and respective outer eccentric sleeves 5, 7 and 6, 8 to each other by means of a piston-cylinder drive 21, the piston of which travels a predetermined stroke to displace the angle-shaped lever 20 connected thereto. The angular adjustment of the inner sleeves is below the angular adjustment of the outer eccentric sleeves. The ratio between these adjustments amounts to 1:2.

With reference to FIGS. 1 and 2 it will be seen that the adjustment of the eccentric sleeves 5 to 8 of the blanket cylinders is carried out in such manner that the blanket cylinders 9, 10 in the opposite direction, as referred to an axis or line g, which connects the central axes of the pins 1 and 2 of the blanket cylinders 9 and 10 to each other in the connected or adjusted position, move in the region near the contact area almost linearly at the calculated angle relative to line g, and in region, remote from the contact area, along a curved path, whereby the play formed between the respective blanket cylinder 9, 10 and the respective plate cylinder 11, 12 is constant (ratio 1:1) in the region near the contact area while that play in the region remote from the contact area increases. The central axis of the respective plate cylinder 11, 12 is provided on the straight line g' which extends through the central axes of the assigned blanket cylinders 9, 10 in the connected or adjusted position and forms with the direction vector of the approximately linear movement of the central axis of the pin 1, 2 of the blanket cylinder 9, 10 an angle $\delta$. Line g' of the central axes of the connected or adjusted blanket cylinder 9, 10 deviates from straight line g which connect the central axes of blanket cylinders 9 and 10 to each other by an angle $\epsilon$.

Angle $\gamma$ is calculated from three sides of the triangle, the first side BC of which is the length of the half-distance between the central axes of the blanket cylinders 9 and 10 in the adjusted position, the second side AC of which is the length of path b of the almost linear movement of the central axis of the pin 1, 2 of the respective blanket cylinder in the disconnected position, and the third side AB is the sum of the half-distance between the axes of the blanket cylinders and the half of the desired play between the blanket cylinders 9 and 10 at the end of the path of the linear movement.

Angle $\delta$ is calculated from three sides of the triangle, the first side CD of which is the distance between the central axis of the respective plate cylinder 11, 12 and the central axis of the pin 1, 2 of the respective blanket cylinder 9, 10 in the connected position, the second side AB of which is the length of path b of the almost linear movement of the central axis of the pin 1, 2 of the respective blanket cylinder in the disconnected position, and the third side of which AD is the sum formed of the distance between the central axes and the desired width of the play between the blanket cylinder 9, 10 and the respective plate cylinder 11, 12 at the end of the path of the almost linear movement.

The inner and outer eccentric sleeves 5, 7 and 6, 8 are arranged relative to each other so that their eccentricities $e_1$ and $e_2$ lie along the same straight line and include, in the connected position of blanket cylinders 9, 10, with the direction vector of the almost linear movement of the central axis of each pin 1, 2 the right angle. Thereby the lines of the extension of eccentricities $e_1$, $e_2$ in the central axes of pins 1, 2 deviate by an angle which amounts to $-90°$, from the straight line g connecting central axes of pins 1, 2 of the blanket cylinders to each other, in the connected position.

Pulling rod 19 illustrated in FIG. 2 is made longitudinally adjustable by means of a sleeve 22 having a left-hand pitch inner thread, and a right-hand pitch inner thread to adjust forces to connect the respective cylinders to each other.

Upon engaging and disengaging of the blanket cylinders 9, 10, the translatory movement generated by the piston of the thrust piston drive 21, acting as a force source, is transmitted via the pivotal lever 20 which moves the pulling rod 19 to lever 18 with the drive toothed segments integrally formed therewith. The toothed segment 17 transmits the angular adjustment via the respective toothed segment 16 to the inner eccentric sleeves 5, 6 while the toothed segment 14 translates the angular adjustment directly to the outer eccentric sleeves 7, 8 so that the angular adjustment of the respective inner eccentric sleeve falls below the angular adjustment of the outer eccentric sleeve and is opposite thereto in the direction of rotation.

The left-hand rotation angular adjustment of drive toothed segments 14, 17 rigidly connected with the lever 18 results for example for the inner eccentric sleeves 5, 6 in the left-hand turn at half the angular amount, and for the outer eccentric sleeves 7, 8 in the right-hand turn at the whole angular amount. The eccentricity and the toothed segment transmission are dimensioned so that the blanket cylinder 9 is moved approximately linearly at the angle relative to the straight line g to the left. The contact between two blanket cylinders is ceased and they become disengaged from each other. At the same time, blanket cylinders 9, 10 become disconnected from the respective plate cylinders 11, 12 as necessary for the adjustment of the required play between the respective cylinders. The width of the play is constant near the region of contact. In the region remote from the contact area, blanket cylinders 9, 10 move away from each other over the curved path so that the width of the play between two blanket cylinders 9, 10 increases greater than the play width between the respective blanket cylinder 9, 10 and respective plate cylinder 11, 12.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims.

I claim:

1. In an engagement-and-disengagement device for blanket cylinders in combination with a four cylinder printing assembly of a roller rotary printing machine in which axes of rotation of four cylinders positioned one above another lie on a straight line inclined to a direction of a running path and pins of said blanket cylinders are arranged each in two eccentric sleeves supported in bores of a wall of the printing assembly, the improvement comprising a ratio between an eccentricity ($e_1$) of an inner sleeve of each blanket cylinder and an eccentricity ($e_2$) of an outer sleeve of each blanket cylinder being greater than 1:1; gear transmission means (13–17) forcibly connecting said eccentric sleeves to each other; and drive means including a thrust piston drive (21), a pulling rod operatively connected to said drive, and a pivotal lever (18) connected to said pulling rod; said gear transmission means including drive toothed segments (14, 17) rigidly connected to said lever, and toothed segments on said inner and outer eccentric sleeves, said drive means via said gear transmission means adjusting the respective inner eccentric sleeve and outer eccentric sleeve by an angular amount in opposite directions relative to each other, and an angular amount of adjustment of a respective inner eccentric sleeve being smaller than the angular amount of adjustment of a respective outer eccentric sleeve, said inner and outer sleeves of each blanket cylinder being adjusted in such a fashion that the blanket cylinders move in opposite directions in reference to the straight line (g), on which the central axes of the pins of the blanket cylinders lie in an engaged position of the blanket cylinders, and approximately linearly in a region near a contact area between said blanket cylinders at a calculable angle $\gamma$ to said straight line and in a region remote from said contact area over a curved path, whereby a ratio between a width of a play formed between said blanket cylinders and a width of a play formed between the respective blanket cylinder and a respective plate cylinder of said printing assembly is 1:1 in said region near said contact area and increases in the region remote from said contact area, and central axes of said plate cylinders lie on a straight line (g') which extends through the central axis of the pin of the respective blanket cylinder in said engaged position and forms with a direction vector of an approximately linear movement of said central axis of the pin of the blanket cylinder a calculable angle δ.

2. The combination as defined in claim 1, wherein said ratio between the eccentricity of the inner sleeve and the eccentricity of the outer sleeve is 4:1.

3. The combination as defined in claim 1, wherein a ratio between the angular amount of adjustment of said inner sleeve and the angular amount of adjustment of said outer sleeve is 1:2.

4. The combination as defined in claim 1, wherein said drive means further include a threaded sleeve (22) positioned on said pulling rod and provided with a left-hand pitch and a right-hand pitch so that said pulling rod which has a thread thereon is adjustable in length for adjusting forces for engaging and disengaging said cylinders.

* * * * *